US008191892B2

(12) United States Patent
Fuda

(10) Patent No.: US 8,191,892 B2
(45) Date of Patent: Jun. 5, 2012

(54) FEED DEVICE AND IMAGE FORMING APPARATUS

(75) Inventor: Munehisa Fuda, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 45 days.

(21) Appl. No.: 12/627,085

(22) Filed: Nov. 30, 2009

(65) Prior Publication Data

US 2010/0148430 A1 Jun. 17, 2010

(30) Foreign Application Priority Data

Dec. 11, 2008 (JP) ..... 2008-315229

(51) Int. Cl.
*B65H 1/00* (2006.01)

(52) U.S. Cl. ..... 271/241; 271/171

(58) Field of Classification Search ..... 271/241, 271/171, 145
See application file for complete search history.

(56) References Cited

U.S. PATENT DOCUMENTS

| | | | | |
|---|---|---|---|---|
| 4,030,725 | A * | 6/1977 | Fukui et al. | 271/164 |
| 5,632,477 | A * | 5/1997 | Morinaga | 271/127 |
| 7,694,959 | B2 * | 4/2010 | Shimazu et al. | 271/171 |
| 7,753,607 | B2 * | 7/2010 | Tan et al. | 400/624 |
| 7,871,072 | B2 * | 1/2011 | Rowe et al. | 271/234 |
| 2007/0280768 | A1 * | 12/2007 | Allwright | 400/624 |
| 2008/0297580 | A1 | 12/2008 | Fukumoto et al. | |
| 2009/0206544 | A1 * | 8/2009 | Allwright | 271/145 |
| 2010/0117291 | A1 * | 5/2010 | Bridges et al. | 271/171 |

FOREIGN PATENT DOCUMENTS

| | | | |
|---|---|---|---|
| JP | 02056340 | A * | 2/1990 |
| JP | 04144840 | A * | 5/1992 |
| JP | 2006-193262 | | 7/2006 |

* cited by examiner

*Primary Examiner* — Kaitlin Joerger
(74) *Attorney, Agent, or Firm* — Cooper & Dunham LLP

(57) ABSTRACT

A feed device includes a paper tray on which sheets are stacked and a side fence that guides a side edges of a sheet stacked on the paper tray in a sheet feed direction. The feed device feeds an uppermost sheet from the sheets stacked on the paper tray to an image forming apparatus. A plurality of concavities and convexities integrally formed with an identical material to the side fence is formed on a surface of the side fence that is in contact with an edge face of a fed sheet.

15 Claims, 9 Drawing Sheets

FEED DEVICE AND IMAGE FORMING APPARATUS

CROSS-REFERENCE TO RELATED APPLICATIONS

The present application claims priority to and incorporates by reference the entire contents of Japanese Patent Application No. 2008-315229 filed in Japan on Dec. 11, 2008.

BACKGROUND

1. Technical Field

This disclosure relates to a feed device that feeds sheets to an image forming apparatus that then forms an image on the sheet.

2. Description of the Related Art

In an image forming apparatus, generally, sheets are pulled out one by one from a paper tray and those sheets are then sequentially fed into an image forming unit or a printing unit for printing an image on the sheets.

Japanese Patent Application Laid-open No. 2006-193262 teaches to provide blowing ports for dry wind on a side fence of the paper tray. When a sheet is fed from the paper tray, dry wind is blown from the blowing ports onto the side edges of the sheet so that the sheet is easily separated from the other sheets in the paper tray. With this configuration, it is prevented that plural sheets are fed at a time or no sheets is fed at all.

Meanwhile, various types of sheets are used in image forming apparatuses. For example, in addition to sheets of standard sizes, label sheets are used. After printing the label sheets, the labels are used as stickers for sticking to products etc.

In a typical label sheet, a mount paper and a label paper are adhered to each other an adhesive. The adhesive sometimes leaks from the side edges of the label sheet. If such a label sheet is stacked in the paper tray, the adhesive adheres to a side fence or a surface of a pressing member arranged on a sheet-passing surface of the side fence. This can cause feeding failure due to the conveying load of the adhesive or dirt on side edges of the sheet due to re-adhesion of the adhesive.

Therefore, each time a label sheet is set in the paper tray, to prevent subsequent occurrence of feeding failure, the user must wipe off the side fence and the pressing member to remove any adhesive adhering to them.

The technique of blowing dry wind disclosed in Japanese Patent Application Laid-open No. 2006-193262 is useless if sheets are adhered to each other with an adhesive that has leaked from a label sheet.

BRIEF SUMMARY

In an aspect of this disclosure, there is provided a feed device including a paper tray on which one or more sheets are stacked; and a side fence that guides a side edge of a sheet stacked on the paper tray in a sheet feed direction. The feed device feeds an uppermost sheet from the sheets stacked on the paper tray one by one to another device. A plurality of concavities and convexities integrally formed with an identical material to the side fence is formed on a surface of the side fence that is in contact with a side edge of the sheet when the sheet is being fed.

According to another aspect, there is provided a feed device including a paper tray on which one or more sheets are stacked; and a side fence that guides a side edge of a sheet stacked on the paper tray in a sheet feed direction. The feed device feeds an uppermost sheet from the sheets stacked on the paper tray one by one to another device. The side fence includes a pressing member that presses the side edge of the sheet. A plurality of concavities and convexities integrally formed with an identical material to the pressing member is formed on a surface of the pressing member.

According to still another aspect, there is provided an image forming apparatus comprising the above feed device.

The aforementioned and other aspects, features, advantages and technical and industrial significance will be better understood by reading the following detailed description of presently preferred embodiments, when considered in connection with the accompanying drawings.

DETAILED DESCRIPTION OF THE PREFERRED EMBODIMENTS

Exemplary embodiments of the present invention are explained below with reference to the accompanying drawings.

Figure 1:
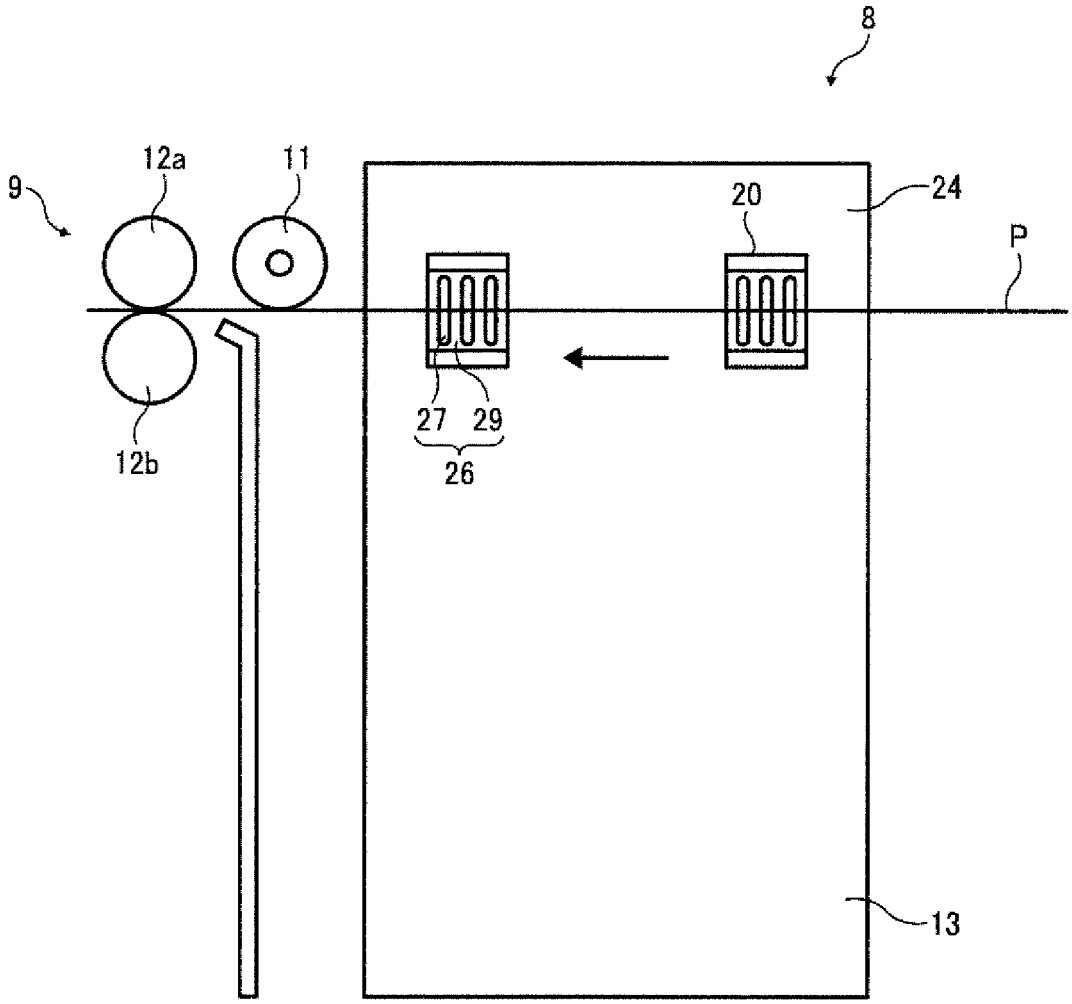
FIG. 1 is a longitudinal sectional view that illustrates the schematic configuration of a feed device according to a first embodiment of the present invention.
Figure 3:
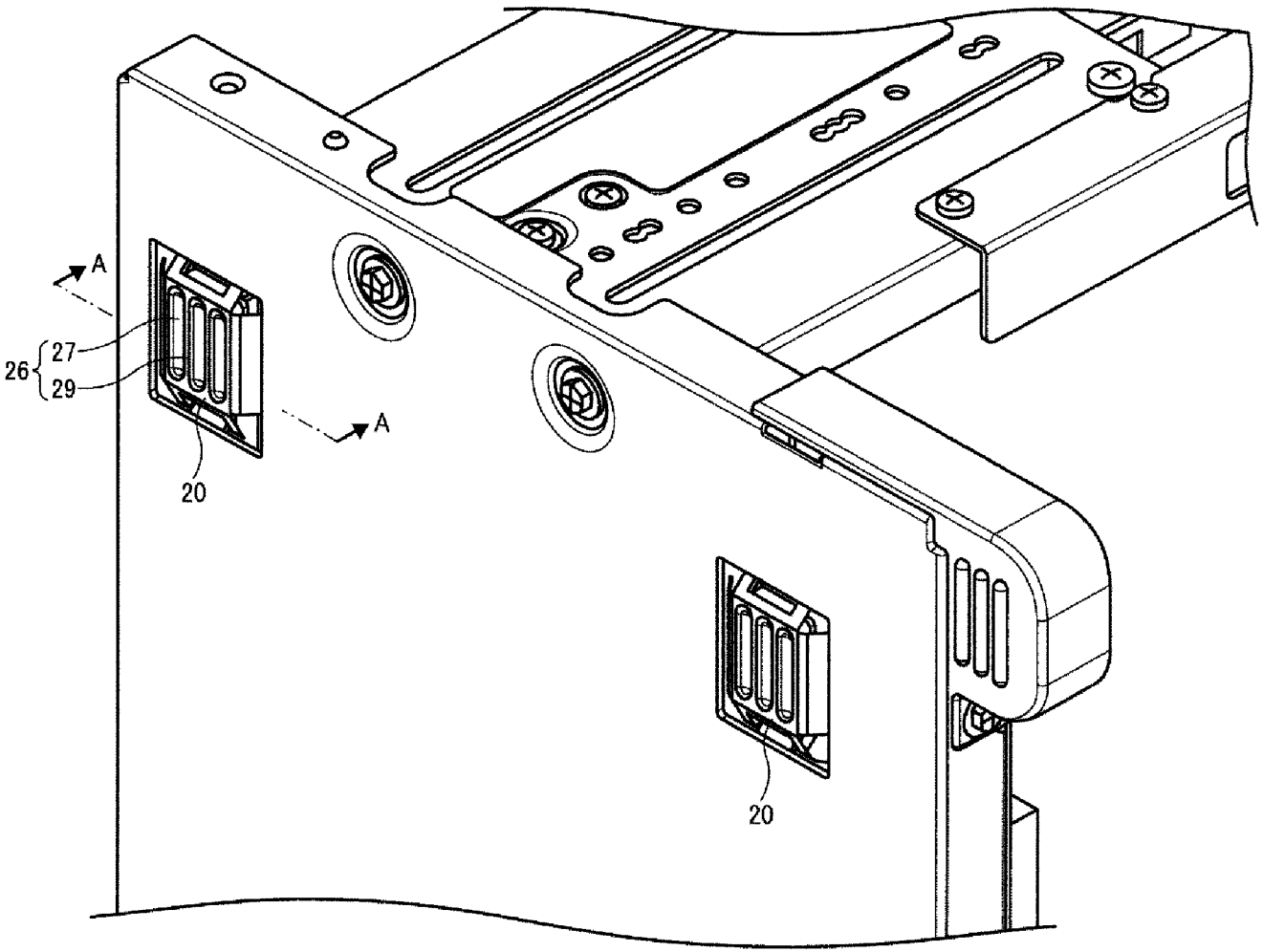
FIG. 3 is an enlarged perspective view of a side fence.
Figure 4:
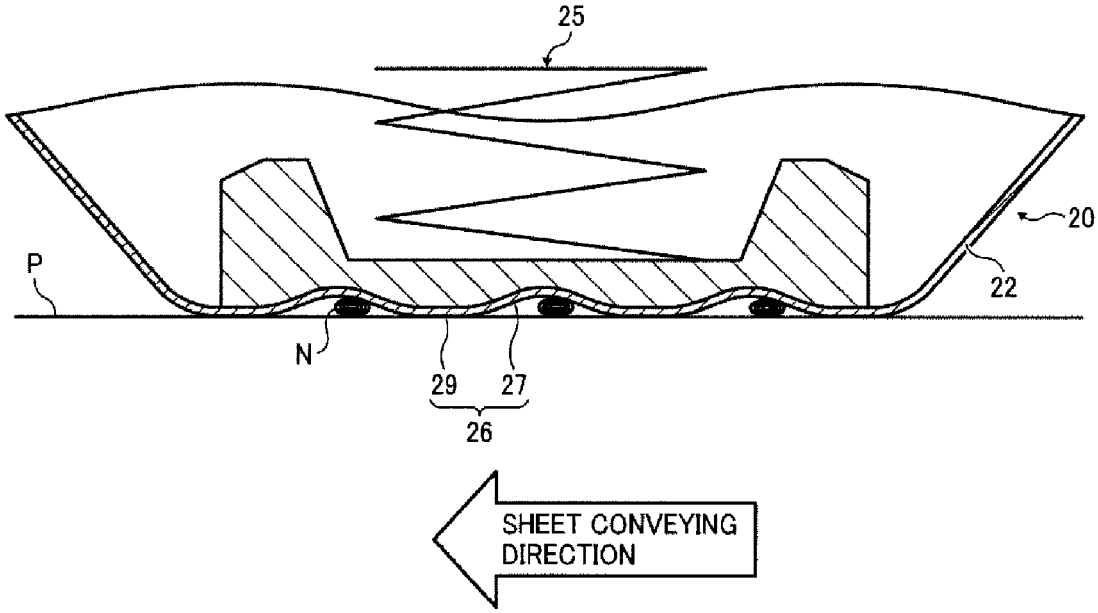
FIG. 4 is a cross-sectional view taken along the line A-A illustrated in FIG. 3.

A first embodiment of the present invention will be first explained with reference to FIGS. 1 to 5. FIG. 1 is a longitudinal sectional view that illustrates the schematic configuration of a feed device 5 according to the first embodiment, FIG. 2 is a perspective view of the feed device 5, FIG. 3 is an enlarged perspective view of a side fence of the feed device 5, FIG. 4 is a cross-sectional view taken along the line A-A illustrated in FIG. 3, and FIG. 5 is a configuration diagram of an image forming apparatus 1 according to the first embodiment in which the feed device 5 is employed.

Figure 5:
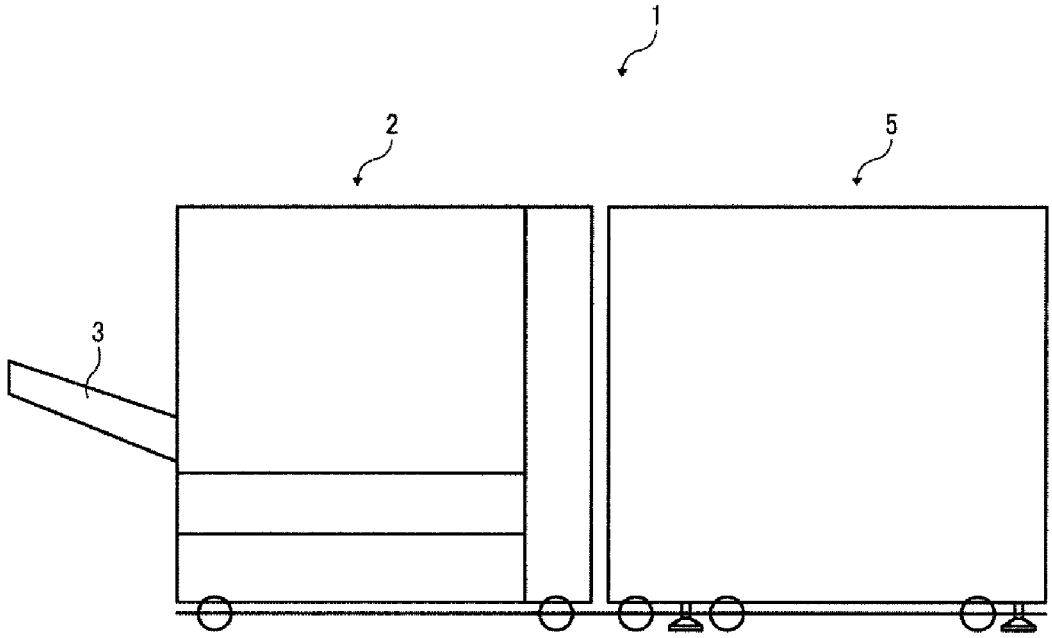
FIG. 5 is a configuration diagram of an image forming apparatus according to the first embodiment.

As illustrated in FIG. 5, the image forming apparatus 1 includes an image-forming main body 2 and the feed device 5. The feed device 5 is connected to one side surface of the image-forming main body 2. The feed device 5 feeds sheets one by one into the image-forming main body 2. The image-forming main body 2 prints an image on the sheets and discharges the image-printed sheets into a discharge tray 3.

Figure 2:
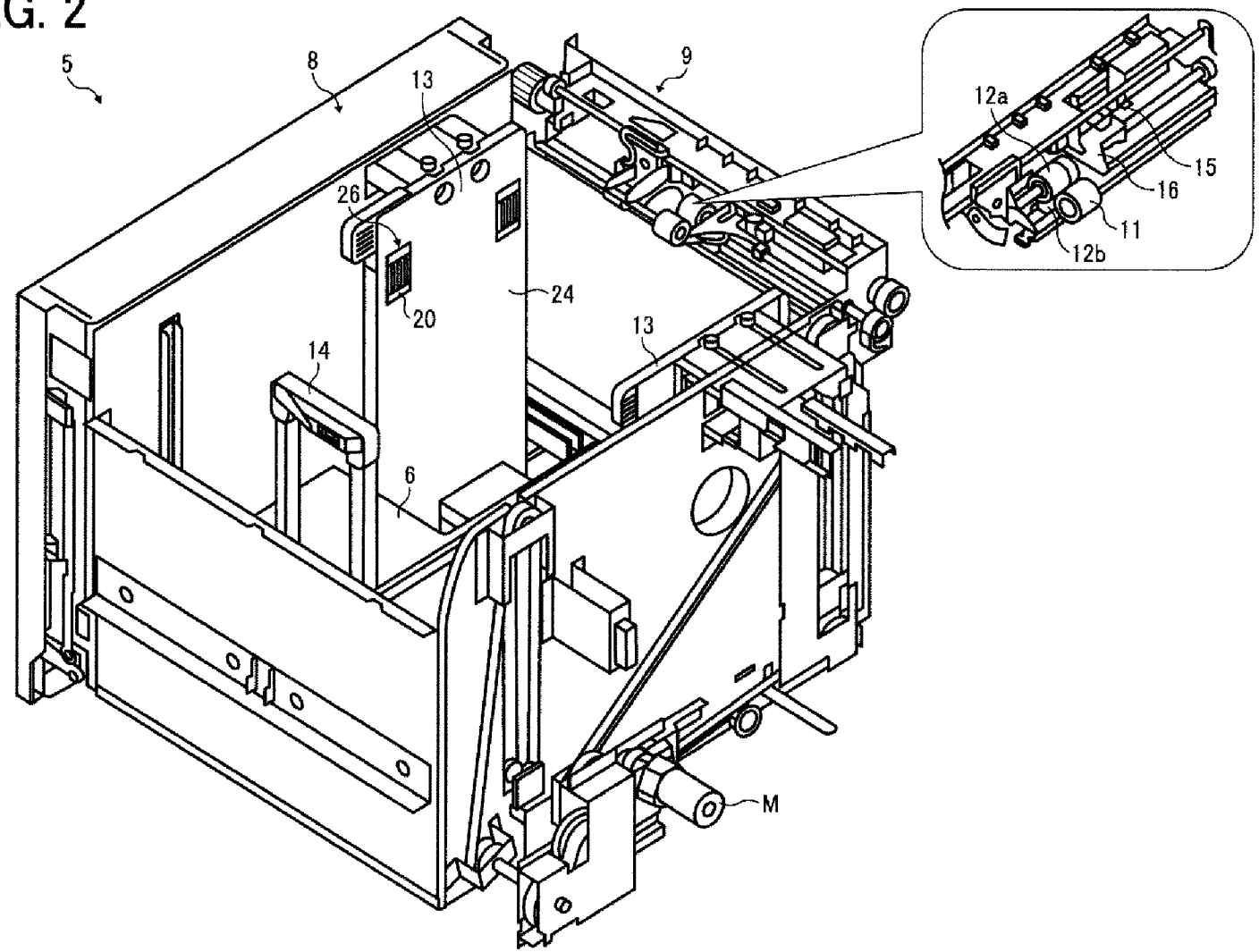
FIG. 2 is a perspective view of the feed device according to the first embodiment.

As illustrated in FIG. 2, the feed device 5 includes a sheet storage unit 8 that includes a paper tray 6 for stacking thereon a pile of sheets and a feed unit 9 that pulls out a sheet from the top of the pile of sheets one by one and feeds the sheet to the image-forming main body 2.

A feed roller 11, a separation roller 12*a*, and a return roller 12*b* are arranged in the feed unit 9. The rollers 11, 12*a*, and 12*b* are driven to be rotated at the respective preset feed timings.

A pair of side fences 13 that guide the sides of the pile of sheets stacked on the paper tray 6 in a width direction (a direction perpendicular to a feed direction) are arranged on both sides of the sheet storage unit 8. A rear fence 14 that presses the rear edge of the pile of sheets is arranged behind the pile of sheets.

Detection of the height of the pile of sheets is performed by a sensor 15. The sensor 15 can be a photo interrupter. The feed position of sheets is detected by the sensor 15. In order to keeps the feed position of sheets same even when the height of the pile of sheets changes, the paper tray 6 is moved up or down with a lifting motor M. Thus, in order to maintain a stable feed separation condition, the top surface of the pile of sheets is always maintained at the same position even if the number of sheets in the pile of sheets varies.

An actuator 16 operates the sensor 15. The actuator 16 has a configuration that it is coupled to the feed roller 11, the separation roller 12*a*, and the return roller 12*b*. Moreover, a filler is arranged at an end of the actuator 16 and the filter intercepts light from entering the sensor 15. With this configuration, the sensor 15 can always detect the top surface of the pile of sheets and the feed roller 11 is always maintained at one position. As a result, even if the paper tray 6 is moved up in due to a decrease in the number of stacked sheets, the position detection is performed by the sensor 15 by being moved by the actuator 16 to an appropriate position.

The sheet storage unit 8 is configured such that it can be inserted into or removed from a feed-device main body. When a user wants to place sheets in the sheet storage unit 8, he extracts the sheet storage unit 8 from the feed-device main body and then stacks sheets in the sheet storage unit 8.

Pressing members 20 are arranged on the respective opposing surfaces of the pair of side fences 13, 13. The surfaces of the pressing members 20 protrude from sheet-passing surfaces 24 of the side fences. The pressing members 20 are arranged at two positions in a sheet-passing direction.

As illustrated in FIG. 4, each of the pressing members 20 has a structure such that it protrudes with a biasing force due to an elastic member 25, such as a spring or a sponge, and the side edges of the stacked sheets are pressed by the pressing members 20 from both sides with a predetermined biasing force so that a sheet P is held at a center position between the pair of side fences 13, 13 in the direction that intersects with the conveying direction.

Concavities and convexities 26 are arranged on the surface of each of the pressing members 20. The concavities and convexities 26 include concavities 27 and convexities 29 that are alternately formed in the conveying direction of the sheet P and each extend in a vertical direction. The concavities 27 and the convexities 29 are formed by embossing a surface member 22 of the pressing member 20.

Next, an explanation will be given of the advantages of the feed device 5. As illustrated in FIG. 1, both sides of the sheet P stacked on the paper tray 6 in a sheet conveying direction are guided by the side fences 13, 13, and the sheet P to be fed is separated one by one by the feed roller 11, the separation roller 12*a*, and the return roller 12*b*. Although the sides of the sheet P are in contact with the surface of the pressing member 20 of each of the side fences 13, because the concavities and convexities 26 formed with the concavities 27 and the convexities 29 are formed on the surface of the pressing member 20, the sides the sheet P is in contact with only the convexities 29 while the sheet P is being fed.

If the sheet P is a label sheet, and adhesive has leaked from its sides, as illustrated in FIG. 4, the adhesive N at the side of the sheet P is scraped off by the convexities 29 and tresses of the adhesive N accumulate in the concavities 27. Therefore, it is possible to prevent the conveying failure of the sheet P and the dirt of the side edges of the sheet that occur because the adhesive N running off the sheet P adheres again to the sheet P or the adhesive N adheres to the subsequent sheet P so that the sheet P can be supplied in a stable manner. Moreover, because the adhesive N adhering to the sides edges of the sheet accumulates in the concavities 27 and the convexities 29 that is in contact with the side edges of the sheet is maintained in a clean condition, it is possible to reduce the user's labor for cleaning the side fences 13.

Furthermore, in the first embodiment, because the concavities 27 and the convexities 29 are alternately arranged on the surface of the pressing member 20 and both the sides of the label sheet in the conveying direction are in point contact with only the convexities 29 on the pressing member 20, when the label sheet passes, a surface pressure applied to the side edges of the label sheet is lower compared to a flat surface, whereby it is possible to reduce adhesion of the adhesive to the pressing member 20.

An explanation will be give below of the other embodiments of the present invention. In the embodiments described below, the same reference numerals are attached to the same parts as those in the above-described embodiment so that detailed explanations of the parts are omitted and an explanation is given mainly of the points that are different from the above-described embodiment in the following explanations.

Figure 6:
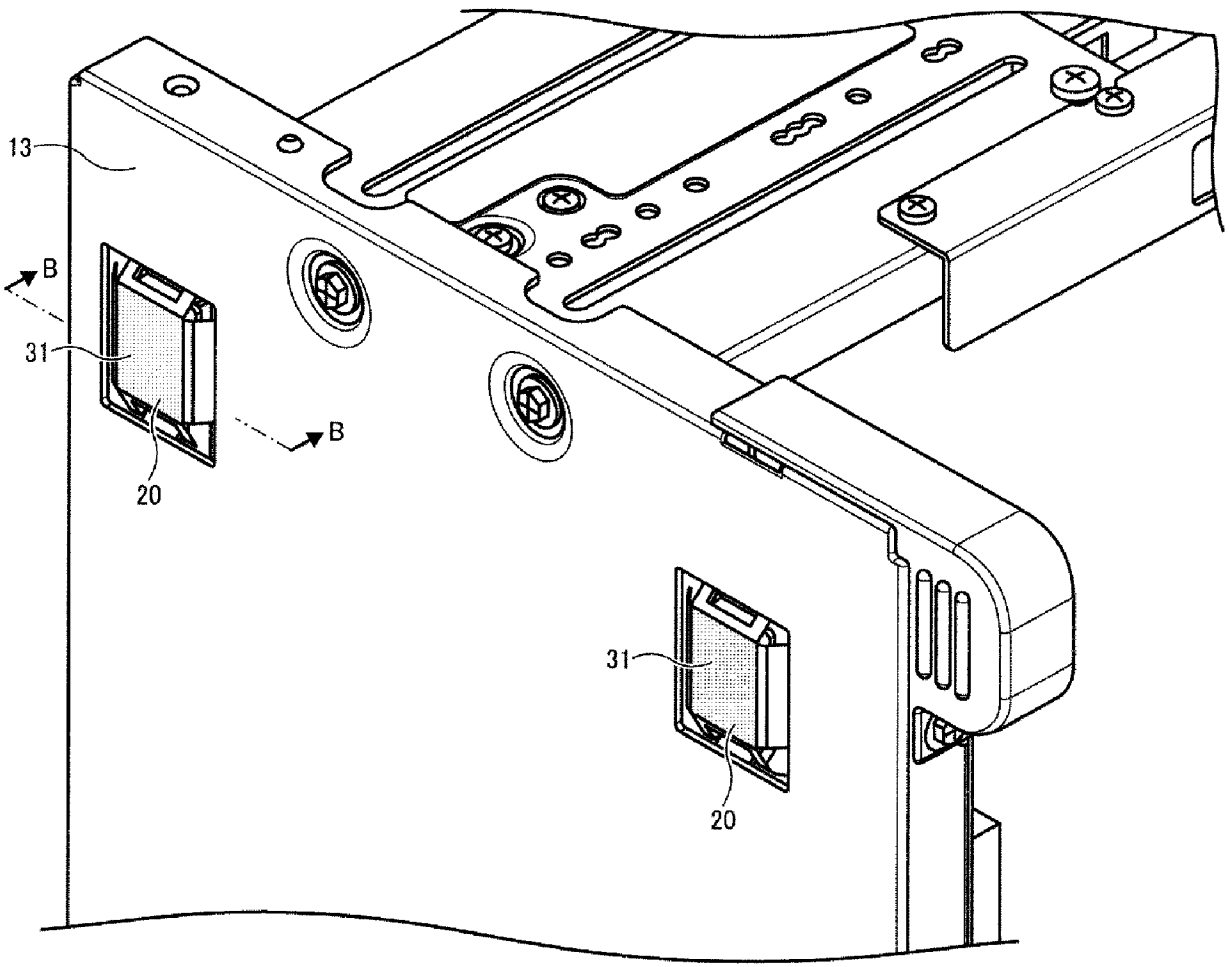
FIG. 6 is an enlarged perspective view of a side fence of a feed device according to a second embodiment of the present invention.

A second embodiment will be explained with reference to FIGS. 6 and 7. FIG. 6 is an enlarged perspective view of a side fence of a feed device according to the second embodiment, and FIG. 7 is a cross-sectional view taken along the line B-B illustrated in FIG. 6.

In the second embodiment, the concavities and convexities of the surface member 22 (see FIG. 7) of the pressing member 20 are formed into a zigzag surface (rough surface) by sandblasting, or the like.

Because the surface of the pressing member 20 is formed into zigzag surface with concavities and convexities 31, both sides of the label sheet, which is in contact with the pressing member 20, in a conveying direction are in point contact with the pressing members 20.

Figure 7:
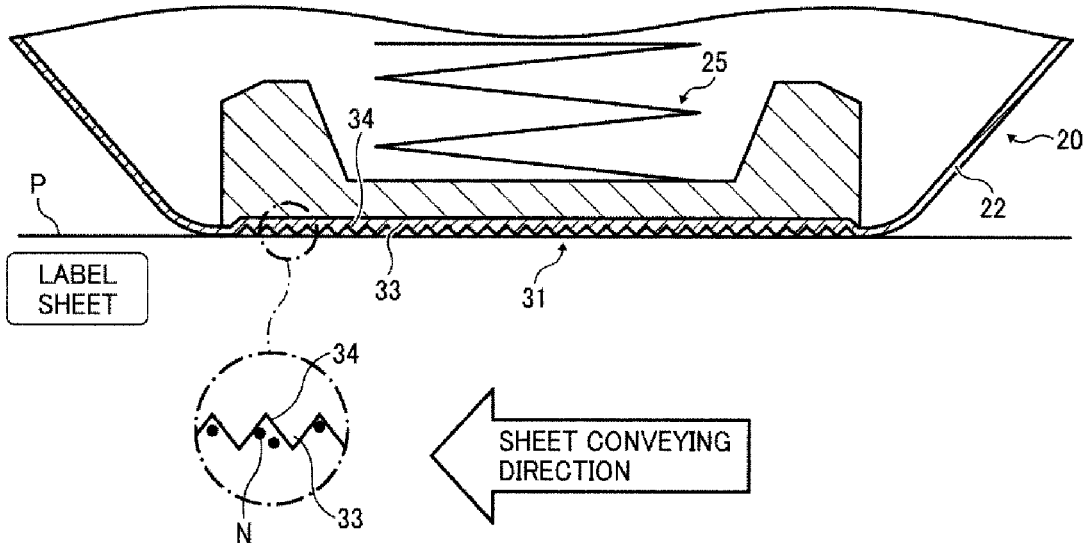
FIG. 7 is a cross-sectional view taken along the line B-B illustrated in FIG. 6.

In the second embodiment, as illustrated in FIG. 7, in the same manner as the first embodiment, the adhesive N leaking from the sides of the label sheet is scraped off by a convex portion 33 and the adhesive N accumulates in a concave portion 34. Therefore, it is possible to prevent conveying failure of the sheet P and the dirt of the side edges of the sheet that occur because the adhesive N adheres again to the sheet P or the adhesive N adheres to the subsequent sheet P so that the sheet P can be supplied in a stable manner. Moreover, because the adhesive N accumulates in the concave portion 34 so that the convex portion 33 that is in contact with the side edges of the sheet is always maintained in a clean condition, it is possible to reduce the user's labor for cleaning the side fence 13.

Furthermore, in the second embodiment, because the surface of the pressing member 20 is formed into the zigzag surface with concavities and convexities 31 and both the side edges of the label sheet in the conveying direction are in point contact with the pressing members 20, when the label sheet passes, a surface pressure applied to the side edges of the label sheet is lower compared with a flat surface, whereby it is possible to reduce the adhesion of the adhesive to the pressing member 20.

The interval between the concavity and the convexity of the zigzag surface, the height of the concavity, and the depth of the concavity (the degree of the concavity and convexity) can be decided as appropriate in accordance with the type or thickness of the label sheet, the amount or viscosity of the adhesive N used in the label sheet, or the like. Moreover, a plurality of types of pressing members with a different degree of concavity and convexity could be prepared and changed as appropriate.

Figure 8:
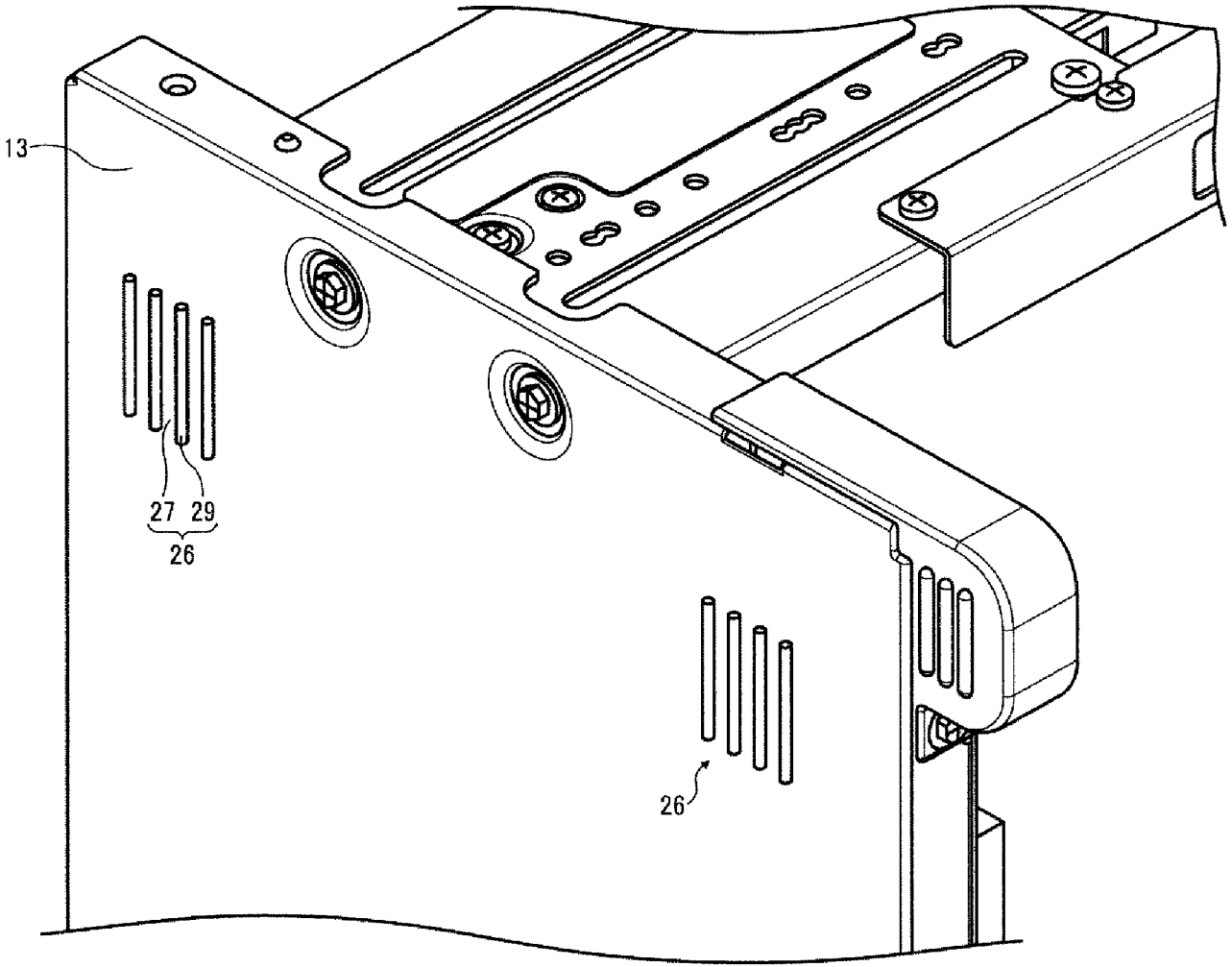
FIG. 8 is an enlarged perspective view of a side fence of a feed device according to a third embodiment of the present invention.

Next, an explanation will be given of a third embodiment of the present invention with reference to FIG. 8. FIG. 8 is an enlarged perspective view of the side fence 13 of a feed device according to the third embodiment.

The third embodiment is different from the above-described first embodiment in that the concavities and convexities 26 are directly formed on the surface of the side fence 13. That is, the pressing member 20 of the first embodiment is not provided.

In the third embodiment, although the convexities 29 and the concavities 27 of the concavities and convexities 26 are directly formed on the surface of the side fence 13, the convexities 29 are formed on the surface of the side fence 13 with intervals so that the concavities 27 are relatively formed between the convexities 29.

The same advantages as that in the above-described first embodiment can be produced in the third embodiment.

In the third embodiment, although the line-shaped concavities and convexities 26 formed with the convexities 29 and the concavities 27 are arranged at two positions with an interval in the conveying direction of the sheet P, the present invention is not limited to this and the line-shaped concavities and convexities 26 can be continuously arranged in the conveying direction of the sheet P.

Figure 9:
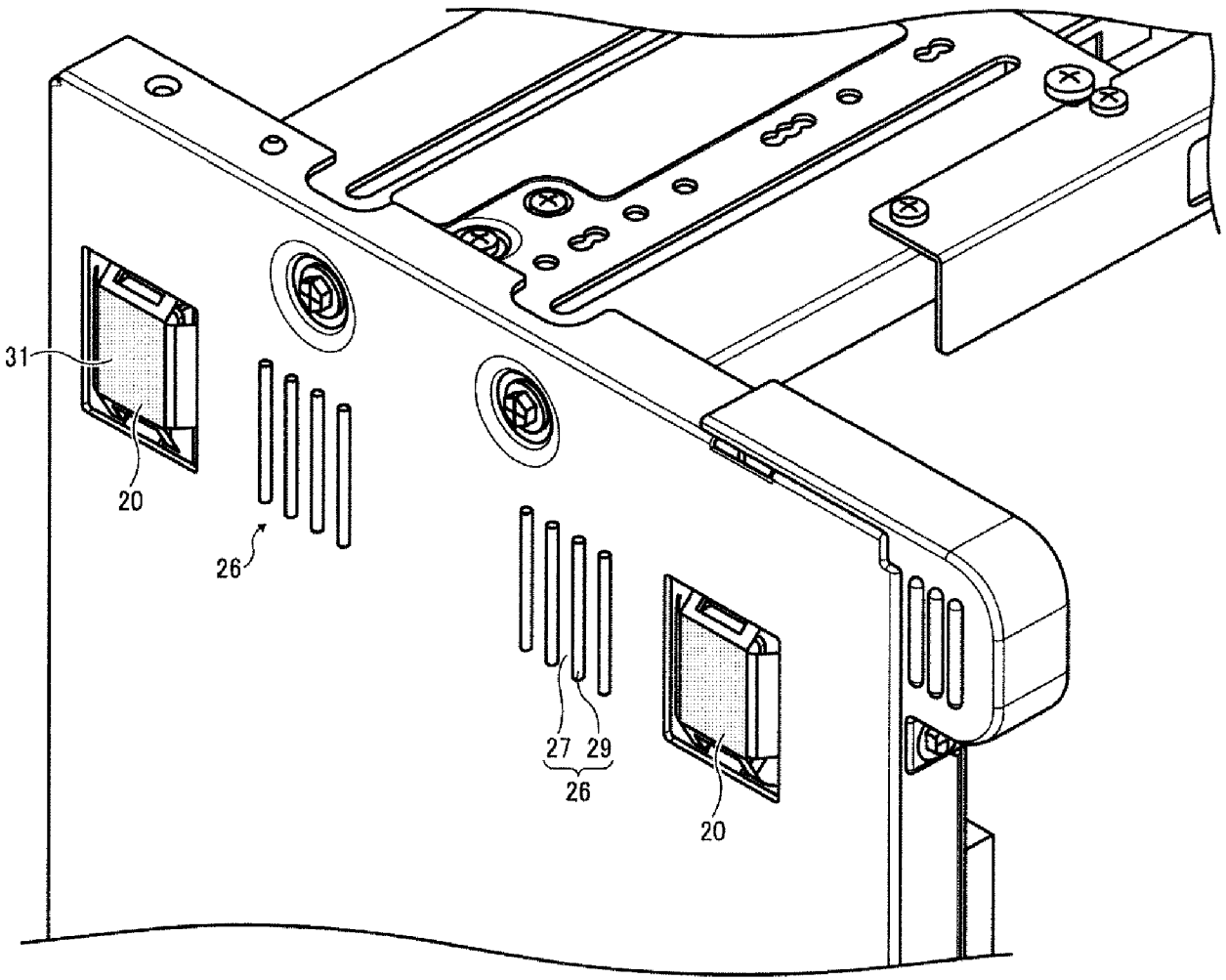
FIG. 9 is an enlarged perspective view of a side fence of a feed device according to a fourth embodiment of the present invention.

An explanation will be given of a fourth embodiment of the present invention with reference to FIG. 9. FIG. 9 is an enlarged perspective view of the side fence 13 of a feed device according to the fourth embodiment.

In the fourth embodiment, the line-shaped concavities and convexities 26 are directly formed on the surface of the side fence 13 and the matte-surface concavities and convexities 31 are formed on the pressing member 20.

In the same manner as the third embodiment, the line-shaped concavities and convexities 26 form the convexities 29 on the surface of the side fence 13 so that the concavities 27 are relatively formed between the convexities 29.

In the same manner as the second embodiment, the zigzag surface with concavities and convexities 31 (the convex portions 33 and the concave portions 34) are formed on the pressing member 20.

According to the fourth embodiment, the advantages of both the above-described first and second embodiments can be obtained and, because the line-shaped concavities and convexities 26 and the zigzag surface with concavities and convexities 31 are combined, an area with concavities and convexities with a wide interval therebetween and a zigzag surface area with a narrow interval between the concavities and the convexities are arranged so that the range of application can be larger even if the amount, the size, the viscosity, or the like, of the adhesive N leaking from the side edges of the sheet is different.

The present invention is not limited to the above-described embodiments, and various modifications can be made without departing from the scope of the present invention.

For example, the convexities 29 may have a shape with a sharp tip so that the scraping performance of the adhesive is improved.

For example, there is no limitation on the interval between the concavities 27 and the convexities 29 and the height of the convexities 29, and they can be set in various manners in accordance with the amount, the size, the viscosity, or the like, of the adhesive used in the label sheets.

In the fourth embodiment, it is possible that the concavities and convexities 26 are formed on the surface of the pressing member 20 and the zigzag surface with concavities and convexities 31 is formed on the surface of the panel.

The present invention is not limited to the configuration such that the paper tray 6 is pushed up by a feed-tray lifting mechanism and the feed device 5 feeds an uppermost sheet stacked on the paper tray 6, and it is possible that a pick-up roller is pushed down to feed a sheet without lifting the paper tray 6.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feed device configured to feed sheets in a sheet feed direction, said feed device comprising:

a paper tray on which one or more sheets are stacked; and a side fence that guides a side edge of a sheet stacked on the paper tray in the sheet feed direction, wherein the feed device feeds an uppermost sheet from the sheets stacked on the paper tray one by one to another device, and a roughly-finished surface integrally formed on a surface of on the side fence is in contact with the side edge of the sheet when the sheet is being fed.

2. A feed device configured to feed sheets in a sheet feed direction, said feed device comprising:

a paper tray on which one or more sheets are stacked; and a side fence that guides a side edge of a sheet stacked on the paper tray in the sheet feed direction, wherein the feed device feeds an uppermost sheet from the sheets stacked on the paper tray one by one to another device, and a plurality of concavities and convexities integrally formed with an identical material to the side fence are formed on a surface of the side fence that is in contact with the side edge of the sheet when the sheet is being fed, and wherein the concavities and convexities are formed in a conveying direction of the sheet, wherein the concavities and convexities are formed with a roughly-finished surface.

3. The feed device according to claim 2, wherein the concavities and convexities are alternately formed in the sheet conveying direction and each extends in a vertical direction.

4. An image forming apparatus comprising the feed device according to claim 1, wherein the image forming apparatus forms an image on a sheet fed from the feed device.

5. A feed device configured to feed sheets in a sheet feed direction, said feed device comprising:

a paper tray on which one or more sheets are stacked; and a side fence that guides a side edge of a sheet stacked on the paper tray in the sheet feed direction, wherein the feed device feeds an uppermost sheet from the sheets stacked on the paper tray one by one to another device, the side fence includes a pressing member that presses the side edge of the sheet, a plurality of concavities and convexities are integrally formed on a surface of the pressing member, and the concavities and convexities are formed in a conveying direction of the sheet.

6. The feed device according to claim 5, wherein the side fence further includes a sheet edge-face contact surface, the sheet edge-face contact surface of the side fence and a sheet edge-face contact surface of the pressing member are arranged in a sheet conveying direction, and the plurality of concavities and convexities integrally formed with an identical material to the side fence is formed on the sheet edge-face contact surface of the side fence.

7. The feed device according to claim 5, wherein the concavities and convexities are alternately formed in the sheet conveying direction and each extends in a vertical direction.

8. The feed device according to claim 5, wherein the concavities and convexities are formed with a roughly-finished surface.

9. The feed device according to claim 6, wherein the concavities and convexities that are alternately formed in the sheet conveying direction and each extends in a vertical direction are formed on one sheet edge-face contact surface out of the sheet edge-face contact surface of the side fence and the sheet edge-face contact surface of the pressing member, and a roughly-finished surface with concavities and convexities is formed on remaining one of the sheet edge-face contact surfaces.

10. An image forming apparatus comprising the feed device according to claim 5, wherein the image forming apparatus forms an image on a sheet fed from the feed device.

11. The feed device according to claim 5, wherein the plurality of concavities and convexities are integrally formed with an identical material to the pressing member.

12. The feed device according to claim 5, wherein the pressing member includes an elastic member that biases the pressing member towards, and to come into contact with, the side edge of the sheet.

13. The feed device according to claim 1, wherein the roughly-finished surface includes a plurality of concavities and convexities integrally formed with an identical material to the side fence.

14. The feed device according to claim 1, wherein the roughly-finished surface includes a plurality of concavities and convexities formed in a conveying direction of the sheet, each of the concavities and convexities extending in a vertical direction.

15. An image forming apparatus comprising the feed device according to claim 2, wherein the image forming apparatus forms an image on a sheet fed from the feed device.

* * * * *